United States Patent [19]

Sherman

[11] 4,383,971

[45] May 17, 1983

[54] METHOD OF CONTROLLING THE SURFACE INTEGRITY OF PILED COAL

[76] Inventor: D. Howard Sherman, 2200 Mayer Rd., St. Clair, Mich. 48079

[21] Appl. No.: 262,392

[22] Filed: May 11, 1981

[51] Int. Cl.[3] ..... B01J 19/00; C10L 5/00; C10L 10/00

[52] U.S. Cl. ..... 422/40; 44/1 R; 414/786

[58] Field of Search ..... 422/40; 44/1 R, 6; 414/133, 786

[56] References Cited

U.S. PATENT DOCUMENTS

| | | | |
|---|---|---|---|
| 2,204,781 | 6/1940 | Wattles | 422/40 X |
| 2,251,321 | 8/1941 | Brown | 422/40 X |
| 3,431,061 | 3/1969 | Chase et al. | 422/40 |
| 3,644,171 | 2/1972 | Bevan et al. | 422/40X |
| 4,169,170 | 9/1979 | Doeksen | 44/6 X |
| 4,201,657 | 5/1980 | Anderson et al. | 44/6 X |
| 4,214,875 | 7/1980 | Kromrey | 44/6 |

FOREIGN PATENT DOCUMENTS

| | | | |
|---|---|---|---|
| 245233 | 1/1961 | Australia | 422/40 |
| 4636 | of 1895 | United Kingdom | 422/40 |

*Primary Examiner*—Barry S. Richman

*Attorney, Agent, or Firm*—Barnes, Kisselle, Raisch, Choate, Whittemore & Hulbert

[57] ABSTRACT

A method for preserving or controlling the surface integrity of piled coal comprising the steps of depositing a straw mulch in a random pattern of straw fibers over at least a portion of the piled coal surface, and simultaneously spraying a bituminous mulch adhesive comprising an emulsion of tar in water over the coal surface in an amount sufficient to form a self-adhesive carpet of straw mulch from one to three inches in thickness. Grass seed may then be broadcast over the mulch carpet, the carpet having a porosity sufficient to permit the seed to drop through the carpet and germinate on the coal surface beneath the carpet.

29 Claims, No Drawings

METHOD OF CONTROLLING THE SURFACE INTEGRITY OF PILED COAL

The present invention relates to coal storage, and more particularly to a method of controlling or preserving the surface integrity of coal stored in piles against erosion by wind or rain and/or against spontaneous surface combustion or the like.

BACKGROUND OF THE INVENTION

It is common practice among utility companies and the like to store coal in substantial quantities at a power plant, and also to stockpile coal at sites remote from the power plant for later use in the event of a coal strike or shortage. Such coal piles may be on the order of seventy feet high and cover several acres of land. In active piles at a utility site, coal is often added to and extracted from the central portion of the pile, while the sides may remain substantially untouched for long periods of time. Stockpiled coal may remain dormant for months at a time.

A number of problems have long plagued utility companies and other coal users in connection with coal storage piles. For example, the wind may carry coal dust from the pile surface for a substantial distance and cause undesirable side effects to the surrounding environment. Similarly, rain may wash or erode the sides of the coal pile. An additional problem, particularly during the summer months, is the hazard of spontaneous combustion at the surface of the coal pile, which may spread to a smoldering fire within the pile itself which is difficult to extinguish.

It is common practice among utility companies, particularly during the summer months, to spray water over the surface of the coal pile to cool the surface and wet down the surface dust against wind and other forms of erosion. However, the water either filters through the interstices in the coal pile or evaporates quickly from the pile surface, so that wetting of the pile surface provides at best only temporary alleviation of the problem.

OBJECTS AND SUMMARY OF THE INVENTION

An object of the present invention is to provide a method for controlling or preserving the surface integrity of piled coal against erosion by wind or rain, spontaneous surface combustion and like hazards which is economical in practice, efficient and long-lasting, which may be readily practiced by relatively unskilled or semi-skilled personnel, and which does not otherwise affect usability of the piled coal for combustion in power plants, etc.

Another and more specific object of the invention is to provide a method for preserving the surface integrity of piled coal as previously described which tends to beautify the otherwise generally unsightly appearance of piled coal as observed from the surrounding environment.

Briefly stated, these and other objects are accomplished in accordance with the invention by depositing on at least a portion of the piled coal surface a mulch of randomly oriented fibrous organic material such as straw or hay, and then spraying over the deposited mulch a suitable mulch adhesive in an amount sufficient to form a porous self-adhesive carpet of mulch covering the surface of the coal pile. The light color of the mulch carpet reflects rather than absorbs sunlight incident on the pile so as to reduce substantially the temperature at the pile surface. Furthermore, the porosity of the mulch carpet admits moisture to the coal itself while permitting ventilation. Additionally, the fibrous organic mulch absorbs and retains moisture, further to reduce the hazard of spontaneous surface combustion.

In the case of dormant coal stockpiles or the side faces of active piles, and in accordance with an additional important aspect of the present invention, grass seed is deposited on the pile surface either before or, more preferably, following deposition of the mulch carpet. The grass seed filters through the carpet pores and germinates beneath the carpet surface, so that the seeded portion of the pile is soon covered by a grass layer which not only synergistically helps prevent erosion in cooperation with the mulch carpet, but also improves the aesthetic appearance of the coal pile to observers in the surrounding environment.

DETAILED DESCRIPTION OF PREFERRED EMBODIMENTS

Straw and hay (including marsh hay) are preferred as the fibrous organic mulch material. Starting fiber lengths in the range of three to twelve inches have proven satisfactory, with the range of six to twelve inches being particularly preferred. When the mulch is deposited in a blowing operation using powered equipment as will be described hereinafter, it has been found that the longer lengths of fibrous materials tend to fracture during the blowing operation, so that the preferred length of fibrous material actually deposited on the pile surface is in the range of three to six inches, with the length of six inches being particularly desirable. Straw, of course, is less expensive than hay, tends to be provided in shorter lengths and is easier to handle. Additionally, straw is more brittle than hay and is more readily fractured during the blowing operation to the preferred length of six inches as previously described. Brittleness of straw is also advantageous when the pile surface is eventually extracted and crushed to powder for combustion in the power plant. For these reasons, straw is presently preferred as mulch material.

As a mulch adhesive, a binder selected from the group consisting of petroleum base bituminous adhesives and water base adhesives is suitable. Asphalt, specifically an emulsion of asphalt in water, is particularly preferred both because of relatively low cost and because of the fact that the BTU content of the asphalt is recoverable during the process of eventual coal combustion (which is true of all bituminous mulch adhesives). A particularly preferred mulch adhesive of the invention is an emulsion of asphalt in water marketed by Bituminous Materials of Michigan in Jackson, Mich. under stock designation SS-1h. Other suitable bituminous mulch adhesives include liquid asphalts, asphalt cements, tar, and heavy oils such as #5 or #6 fuel oils, bunker oils, waste oil or sludge. In general, see *Standard Specification For Highway Construction*, Michigan Department of State Highway and Transportation (1976).

In practice of the invention, the mulch and mulch adhesive are preferably deposited substantially simultaneously. One machine which has been found suitable for accomplishing this operation is the "Eagle Mulch Spreader" marketed by Finn Equipment Co. of Cincinnati, Ohio. This mulch machine includes a conveyor for feeding baled mulch to a blower, and a tube or cannon mounted on a rotatable pedestal for directing blown mulch over the surface of the coal pile such that the mulch fibers are deposited in essentially random orientations. Nozzles are mounted at the open end of the cannon for spraying the mulch adhesive onto the mulch as the latter is blown therefrom over the coal surface. The nozzles may be connected to a suitable heated adhesive tank wagon, such that marketed by the Finn Equipment Co. as an accessory to the "Eagle Mulch Spreader". A train consisting of the adhesive tank wagon, the mulch machine, a suitable wagon for carrying baled straw and a tractor or bulldozer for pulling the train may travel back and forth over the surface of the coal pile while baled mulch and tar are fed to the mulch machine and sprayed by an operator over the pile surface as previously described. Preferably, the tar emulsion is heated above 70° F., which is a minimum recommended temperature for the above-noted machines to prevent plugging of the nozzles, and most preferably to a temperature about 100° F. prior to spraying onto the coal surface.

The mixture of mulch and mulch adhesive is deposited on the coal pile surface in an amount sufficient to form a self-adhesive porous carpet. Early experience in practice of the invention demonstrated that the minimum desirable amounts of adhesive and mulch are those sufficient to form a blanket of carpet which may be grasped by the hand and pulled away from the coal surface without loss of integrity. With further experience, it was found that the amounts of adhesive and mulch may be judged visually during the blowing operation. Generally, the mulch carpet is desirably one to three inches thick and is sufficiently dense that the coal cannot be seen through the carpet. The ultimate criteria on carpet thickness is, of course, that which will achieve the purposes of the invention—i.e. the carpet should be sufficiently loose to allow circulation, but thick enough to shade the pile surface, reduce moisture evaporation and prevent erosion. Where carpet deposition is followed by seeding, the carpet fibers must also have sufficient porosity to permit the seed to penetrate to the pile surface.

Mulch, specifically straw, in the amount of one and one-half tons per acre has proven satisfactory. Adhesive, specifically asphalt emulsion, in the amount of at least seventy to ninety gallons per ton of mulch has been found desirable, with an application rate of about 265 gallons per acre (or about 177 gallons per ton of mulch) being preferred. This adhesive spray rate may be achieved by utilizing nozzles marketed by Finn Equipment Company with the "Eagle Mulch Spreader".

In accordance with a particularly important feature of the invention previously summarized as applied to dormant coal stockpiles, and to the essentially dormant side faces of active coal piles, grass seed is applied to the pile, preferably following simultaneous deposition of the mulch and adhesive mixture as previously described. Perennial rye seed at an application rate of five pounds per thousand square feet has been found to yield satisfactory results. The seed may be broadcast using any suitable means, such as the mulching machine with blower and cannon previously described, or using a suitable manually operated broadcast device. The latter technique is presently preferred for even application of seed over the carpeted coal surface.

Thus, it will be appreciated that the present invention provides an economical method for controlling or preserving the surface integrity of piled coal against erosion by wind, or rain, spontaneous surface combustion and the like which fully satisfies all the objects and aims previously set forth. For example, the process of the invention uses economical materials and is capable of being practiced by relatively unskilled personnel. The fibrous organic mulch and the bituminous mulch adhesive in accordance with the preferred method of the invention may be readily powdered and burned along with the coal when the latter is used without clogging or causing other deleterious effects on the power station coal transport and combustion system.

Although the invention has been described in a particularly efficacious and preferred application thereof with respect to coal stockpiles for utility power stations, it will be recognized that the features and advantages of the invention may be readily utilized in other coal storage and transport application. For example, the mixture of mulch and mulch adhesive may be readily applied over coal loaded into an open rail transport vehicle or piled onto a transport barge so as to reduce emission of coal dust during transport. The mixture of mulch and mulch adhesive dries rapidly and would not delay the transport operation, other than for the relatively brief time required for application.

The invention claimed is:

1. A method of controlling the surface integrity of piled coal against erosion, surface combustion and the like comprising the steps of depositing on at least a portion of the piled coal surface a mulch of fibrous organic material in discrete lengths of not less than three inches in random fiber orientations over said portion of said surface and spraying over said portion of said surface a mulch adhesive in an amount sufficient to form a self-adhesive water and air permeable carpet of said mulch covering said portion of said surface and through which said portion of said surface is substantially invisible.

2. The method set forth in claim 1 comprising the additional step of depositing grass seed on said portion of said surface.

3. The method set forth in claim 2 wherein said grass seed is deposited in an amount substantially equal to five pounds per one thousand square feet of said surface.

4. The method set forth in claim 2 or 3 wherein said step of depositing said grass seed is carried out following said step of depositing said mixture of mulch and mulch adhesive.

5. The method set forth in claim 4 wherein said grass seed comprises perennial rye seed.

6. The method set forth in claim 1 or 2 wherein said mulch adhesive is selected from the group consisting of petroleum base binders, water base binders and mixtures thereof.

7. The method set forth in claim 6 wherein said mulch adhesive comprises a bituminous binder.

8. The method set forth in claim 7 wherein said mulch adhesive is selected from the group consisting of asphalt base and tar base binders.

9. The method set forth in claim 8 wherein said mulch adhesive comprises an emulsion of asphalt in water.

10. The method set forth in claim 1 or 2 wherein said mulch comprises fibrous organic material in lengths of three to twelve inches.

11. The method set forth in claim 10 wherein said fibrous organic material is deposited in a substantially random array over said portion of said surface.

12. The method set forth in claim 11 wherein said lengths are in the range of three to six inches.

13. The method set forth in claim 12 wherein said fibrous organic material is substantially six inches in length.

14. The method set forth in claim 11 wherein said fibrous organic material is selected from the group consisting of hay, straw and mixtures thereof.

15. The method set forth in claim 14 wherein said fibrous organic material comprises straw.

16. The method set forth in claim 10 wherein said mulch comprises straw in lengths of three to six inches.

17. The method set forth in claim 10 wherein said mulch adhesive is selected from the group consisting of petroleum base binders, water base binders and mixtures thereof.

18. The method set forth in claim 17 wherein said steps of depositing said mulch and spraying said mulch adhesive are carried out simultaneously.

19. The method set forth in claim 17 wherein said carpet is one to three inches in depth.

20. The method set forth in claim 17 wherein said step of depositing said mulch is continued until said coal pile surface is no longer visible through said carpet.

21. The method set forth in claim 17 wherein said mulch adhesive comprises a bituminous petroleum base binder.

22. The method set forth in claim 21 wherein said bituminous binder comprises an emulsion of asphalt in water heated above 70° F.

23. The method set forth in claim 21 wherein said mulch is deposited in an amount of about one and one-half tons per acre.

24. The method set forth in claim 23 wherein said mulch adhesive is sprayed at a rate of about 177 gallons per ton of mulch.

25. The method set forth in claim 17 comprising the additional step of broadcasting grass seed over said portion of said surface.

26. The method set forth in claim 25 wherein said step of broadcasting said grass seed is carried out following said steps of depositing said mulch and spraying said mulch adhesive.

27. The method set forth in claim 26 wherein said grass seed comprises perennial rye seed broadcast in the amount of about five pounds per thousand square feet.

28. A method of controlling the surface integrity of piled coal comprising the steps of depositing a straw mulch in a random pattern over at least a portion of the piled coal surface, spraying a bituminous mulch adhesive over said deposited straw mulch in an amount sufficient to form a self-adhesive porous carpet of said straw mulch covering said portion of said surface, and then broadcasting grass seed onto self-adhesive carpet, said carpet being sufficiently porous to permit said seed to drop through said carpet and germinate beneath said carpet.

29. The method set forth in claim 28 wherein said steps of depositing said straw mulch and spraying said bituminous mulch adhesive are carried out simultaneously.

* * * * *